United States Patent [19]

Matula et al.

[11] 4,239,403

[45] Dec. 16, 1980

[54] COUNTERBALANCED BIDIRECTIONAL SHUTTLE DRIVE

[75] Inventors: Jerry Matula, Westminster; Glen R. Radke, Fountain Valley; Gordon B. Barrus, El Segundo, all of Calif.

[73] Assignee: Printronix, Inc., Irvine, Calif.

[21] Appl. No.: 7,789

[22] Filed: Jan. 30, 1979

[51] Int. Cl.[3] ..... B41J 19/04; B41J 19/14

[52] U.S. Cl. ..... 400/322; 101/93.02; 400/283; 400/157.4; 400/161

[58] Field of Search ..... 74/227, 242.11 W, 242.11 L; 101/93.02; 400/283, 319, 320, 322, 157.4, 161

[56] References Cited

U.S. PATENT DOCUMENTS

| | | | |
|---|---|---|---|
| 3,310,146 | 3/1967 | Fielder | 400/157.4 |
| 3,710,913 | 1/1973 | Brennan, Jr. et al. | 400/320 |
| 3,858,702 | 1/1975 | Azuma | 400/320 |
| 3,973,662 | 8/1976 | Fulton | 400/320 |
| 4,030,591 | 6/1977 | Martin et al. | 400/320 |
| 4,084,681 | 4/1978 | Heinzl et al. | 400/320 |
| 4,147,967 | 4/1979 | Aiena | 400/320 |

*Primary Examiner*—William Pieprz

*Attorney, Agent, or Firm*—Fraser and Bogucki

[57] ABSTRACT

A counterbalanced bidirectional drive for a hammer bank shuttle assembly within a line printer utilizes a band formed into an endless loop extending around and between an opposite pair of rotatable pulleys on opposite sides of the pulleys. A hammer bank-carrying shuttle assembly is coupled to a portion of the band between the pulleys on one side of the pulleys and is counterbalanced by an elongated bar of similar mass coupled to a portion of the band between the pulleys on the opposite side of the pulleys from the shuttle assembly. A DC motor coupled to one of the pulleys is alternately energized in opposite senses so as to bidirectionally drive the shuttle assembly along a linear path between opposite limits defined by resilient members impacted by an element mounted on the counterbalancing bar.

17 Claims, 7 Drawing Figures

COUNTERBALANCED BIDIRECTIONAL SHUTTLE DRIVE

BACKGROUND OF THE INVENTION

1. Field of the Invention

The present invention relates to arrangements for driving a member in bidirectional fashion along a linear path, and more particularly to arrangements for reciprocating a shuttle assembly adjacent print paper in a line printer.

2. History of the Prior Art

It is known to provide a line printer in which a shuttle assembly including a hammer bank is driven in reciprocating, bidirectional fashion along a linear path adjacent a platen-supported ribbon and print paper or other printable medium as the individual hammers of the hammer bank are actuated so as to impact the printable medium and effect the desired printing. An example of such an arrangement is provided by U.S. Pat. No. 3,941,051 of Barrus et al, issued Mar. 2, 1976 and commonly assigned with the present application. The arrangement shown in the Barrus et al patent drives the shuttle assembly using a counterbalanced, cam controlled positive drive mechanism. The mechanism has sufficient mass and drive power to maintain substantially constant speed despite the variable braking effect that is introduced during printing and the effect of spring loaded cam follower bearings. The controlling cam surfaces must be precisely generated for the desired trapezoidal velocity function, although substantial wear can have an adverse effect on the nature of the motion. With such an arrangement, a large drive motor and flywheel are desirable for stability, and there are practical limitations on the shuttle rate that can be achieved.

An alternative arrangement which avoids some of the problems present in the system of the Barrus et al. patent and which provides certain other advantages is shown in a co-pending application of Jerry Matula, Ser. No. 765,873, filed Feb. 4, 1977 and commonly assigned with the present application. The printer disclosed in the Matula application drives the shuttle assembly using a linear motor. The linear motor includes a coil coupled for linear movement in conjunction with the shuttle assembly and a surrounding permanent magnet. The coil is bidirectionally energized by a circuit which is sensitive to movement of the shuttle assembly between opposite limits and which energizes the coil in accordance with the difference between the actual and the desired velocity of the shuttle assembly. The coil energizing circuit saturates whenever the actual velocity of the shuttle assembly falls below a minimum value to provide a large driving current to the coil following reversals in direction and at any other time that high energization of the coil may be needed. For the most part, however, resilient stop elements provide substantial rebounding force on change in direction so that servo control may be employed to provide the small amount of energizing current necessary to maintain the shuttle assembly at a nominal velocity.

The linear driving arrangement described in the Matula application provides a relatively simple and direct approach to bidirectional shuttle assembly driving, and functions efficiently and effectively for most applications. However, there may be certain applications where other arrangements would be more advantageous. This is particularly true in situations where the frame of the printer or other structure for supporting the shuttle drive is not capable of resisting the shaking or other vibratory motion which results from the reciprocating movement of the linear motor or where the system is otherwise incapable of tolerating the vibration and shaking which are usually present with a shuttle drive of that type.

Accordingly, it would be desirable to provide alternative arrangements for driving a shuttle assembly which may provide certain advantages such as substantial reduction in the vibration and similar undesired forces or motions.

BRIEF SUMMARY OF THE INVENTION

Arrangements in accordance with the invention bidirectionally drive a shuttle assembly through a path of linear motion using a low friction, counterbalanced driving arrangement which substantially minimizes or eliminates vibration and other undesired effects which often result from the high speed driving of a shuttle assembly of some mass. At the same time the driving arrangement is of relatively simple design and is readily driven using a circuit similar to that shown in the previously referred to co-pending application of Matula so as to avoid the problems of more complicated prior art arrangements which may minimize vibration and other motion effects at the expense of complexity parts wear and other problems.

Bidirectional shuttle drives in accordance with the invention employ a band formed into an endless loop which partially encircles and extends between a pair of rotatable pulleys on the opposite sides of the pulleys. The pulleys are mounted for rotation about generally parallel, spaced-apart axes with one of the pulleys being coupled to a DC motor via a driving belt or other appropriate arrangement for bidirectional rotation of the pulley. The shuttle assembly is coupled to the band between the pulleys on one side thereof. An elongated, counterbalancing bar having a mass similar to that of the shuttle assembly is coupled to the band between the pulleys on the opposite side of the pulleys from the shuttle assembly. As the shuttle assembly moves in one direction, the opposite counterbalancing bar moves in the opposite direction, and vice versa. This has the effect of greatly minimizing or substantially eliminating vibrations and shaking which might otherwise occur as the shuttle assembly reciprocates between opposite positions at high speeds. The opposite limits of movement of the shuttle assembly are defined by a pair of springs or other resilient members mounted adjacent the counterbalancing bar so as to be impacted by an impact element coupled to the counterbalancing bar. The resulting arrangement provides a structure for reciprocating the shuttle assembly between the opposite limits in a manner which is resisted only by the small amount of friction in the pivotable mounts for the pulleys. The DC motor is bidirectionally driven by a circuit similar to that shown in the previously referred to co-pending application of Matula. Such circuit provides a driving current having a polarity which reverses with the opposite reversals in direction of the shuttle assembly and which is momentarily of large value such as during reversals in the shuttle assembly and otherwise of the relatively small value required to servo the shuttle assembly at a desired nominal velocity.

BRIEF DESCRIPTION OF THE DRAWINGS

The foregoing and other objects, features and advantages of the invention will be apparent from the following more particular description of a preferred embodiment of the invention, as illustrated in the accompanying drawings, in which.

DETAILED DESCRIPTION

Figure 1:
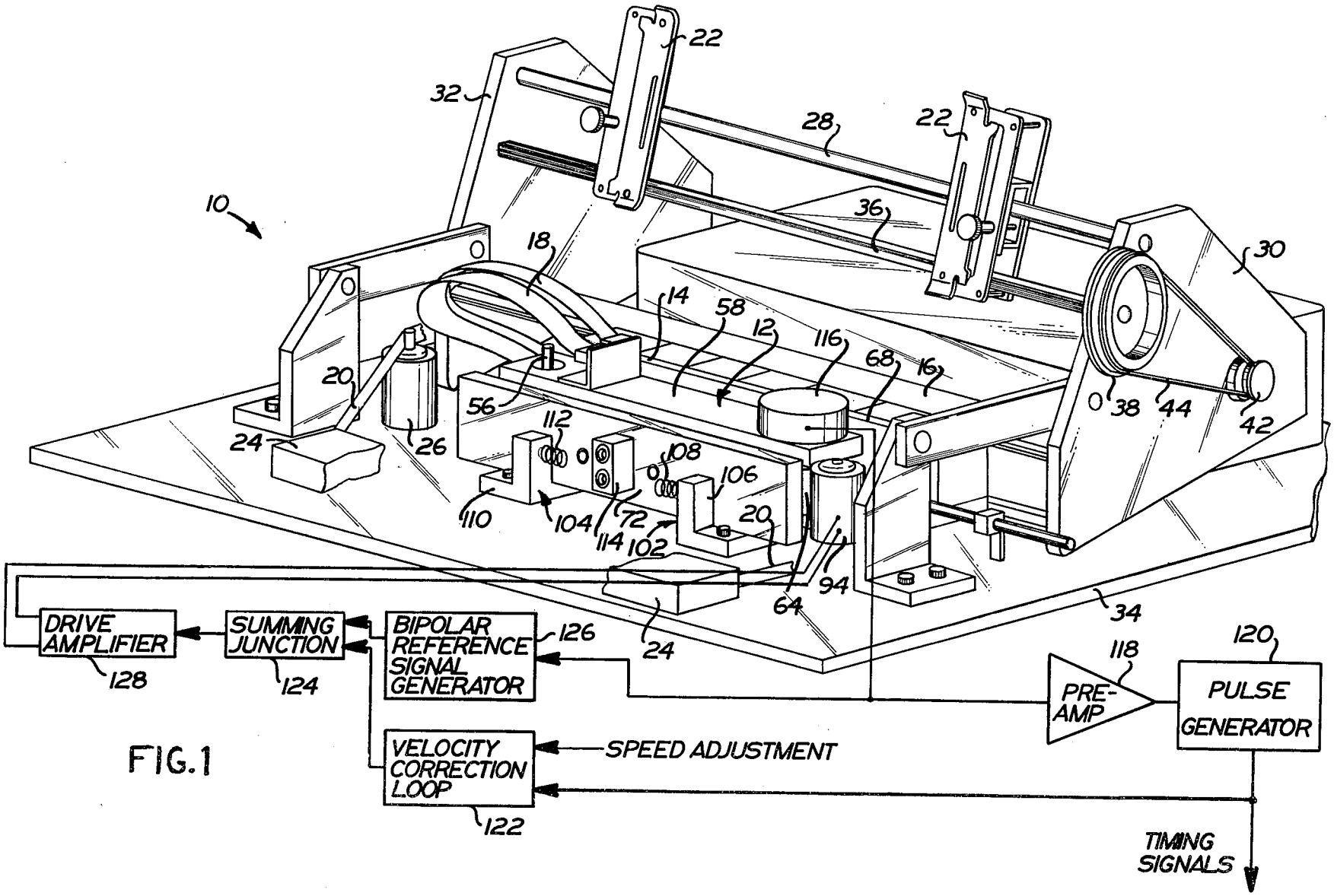
FIG. 1 is a perspective view of a printer employing a counterbalanced bidirectional shuttle drive in accordance with the invention and a block diagram of a circuit for controlling the shuttle drive.

FIG. 1 depicts a printer 10 which includes a counterbalanced bidirectional shuttle drive 12 in accordance with the invention. The shuttle drive 12 reciprocates a shuttle assembly 14 relative to an adjacent platen 16. The shuttle assembly 14 which may assume the configuration of the shuttle assembly shown in previously referred to U.S. Pat. No. 3,941,051 of Barrus et al, or other appropriate configuration, includes a plurality of impact hammers. A wire bus 18 coupled to the shuttle assembly 14 provides selective energization of magnetic circuits associated with the various hammers within the shuttle assembly 14 to selectively impact and thereby imprint dots on a print paper via an ink ribbon 20, portions of which are shown in FIG. 1. The paper, which is not shown for reasons of simplicity, is stepped upwardly and over the platen 16 at a controlled rate using an opposite pair of tractor drives 22 in conventional fashion. A ribbon system 24 of conventional configuration and which is broken away in FIG. 1 is used in conjunction with a motor 26 to drive the ribbon 20 across the paper in the region of the platen 16 in well known fashion.

The tractor drives 22 are supported at the opposite ends of a rod 28 extending along the length of the printer 10 and supported by an opposite pair of mounting plates 30 and 32 mounted on a base plate 34 for the printer. A rod 36 of square cross-section is rotatably mounted within the mounting plates 30 and 32 to drive the tractor drives 22 and thereby effect paper advance in response to rotation of a pulley 38 coupled to the end of the rod 36. A motor mounted on the opposite side of the mounting plate 38 drives the pulley 38 via a pulley 42 and a belt 44.

The details of the shuttle drive 12 in accordance with the invention are shown in FIGS. 2–5 as well as in FIG. 1. The shuttle drive 12 includes a pair of pulleys 50 and 52 mounted for rotation about a pair of spaced-apart, generally parallel vertical axes. The pulley 50 is mounted for rotation by a shaft 54. The pulley 52 is mounted for rotation by a shaft 56. The shafts 54 and 56 are journaled in the opposite ends of a top frame 58 and a bottom frame 60 extending along the length of the shuttle drive 12 by bearings and held in spaced-apart relation by an intermediate frame 62. The bottom frame 60 is mounted directly on the base plate 34 of the printer 10.

A stainless steel band 64 of uniform width is formed into an endless loop which partially encircles and extends between the pulleys 50 and 52 on the opposite sides of the pulleys and the frames 58, 60 and 62. The band 64 which moves in response to rotation of the pulleys 50 and 52 is coupled to the pulleys by one or more screws 66 shown in FIG. 4. The screws 66 insure registration of the band 64 with the pulleys 50 and 52 while at the same time permitting the limited movement of the band 64 necessary to reciprocate the shuttle assembly 14. The band 64 may comprise a continuous length of steel, but preferably has a pair of opposite ends coupled together by one or more springs or other resilient means for tensioning the band and at the same time permitting expansion and contraction of the band with temperature change.

The shuttle assembly 14 is coupled to a portion of the band 64 between the pulleys 50 and 52 on one side of the pulleys by a generally L-shaped frame 68. The shuttle mounting frame 68 which has a length greater than the distance between the pulley shafts 54 and 56 to provide for contact of the frame with the opposite pulleys 50 and 52 through the band 64 during the limited movement undergone by the shuttle assembly 14 is coupled to the band 64 by any appropriate means such as screws.

An elongated, counterbalancing bar 72 is mounted on a portion of the band 64 between the pulleys 50 and 52 on the opposite side of the pulleys from the shuttle assembly 14. Like the shuttle mounting frame 68, the counterbalancing bar 72 has a length greater than the distance between the pulley shafts 54 and 56 so as to remain in contact with the pulleys 50 and 52 through adjacent portions of the band 64 during the limited reciprocating movement of the shuttle assembly 14. The counterbalancing bar 72 which is similar to size and shape to the shuttle assembly 14 and its included mounting frame 68 is chosen in accordance with the invention to have a mass substantially the same as that of the shuttle assembly 14 and included mounting frame 68. The counterbalancing bar 72 has been found to counterbalance the reciprocating motion of the opposite shuttle assembly 14 so as to substantially reduce vibration and shaking despite reciprocation of the shuttle assembly 14 at speeds on the order of 24 inches per second while traveling through a distance of approximately 1.6 inches.

The shuttle mounting frame 68 has the opposite ends thereof held in contact with the pulleys 50 and 52 through adjacent portions of the band 64 by a magnet assembly 74 including a permanent magnet 76 and a pole piece 78. The pole piece 78 which is generally C-shaped has an opposite pair of tips 80 and 82 disposed adjacent and slightly spaced-apart from a thin plate 79 of magnetic material joined to the inner surface of the band 64 with the pole piece 78 mounted on the intermediate frame 62. With the permanent magnet 76 being mounted on an intermediate portion of the pole piece 78 between the opposite tips 80 and 82 so as to be slightly spaced-apart from the thin plate 79, a magnetic circuit is completed which attracts the adjacent portions of the plate 79 to keep the opposite ends of the shuttle mounting frame 68 in contact with the pulleys 50 and 52 through the adjacent portions of the band 44. The opposite tips 80 and 82 of the pole piece 78 provide two different paths for magnetic flux flowing from one pole of the permanent magnet 76 adjacent the pole piece 78 through the opposite legs of the pole piece 78 and through adjacent portions of the thin plate 79 to the opposite pole of the permanent magnet 76.

Figure 4:
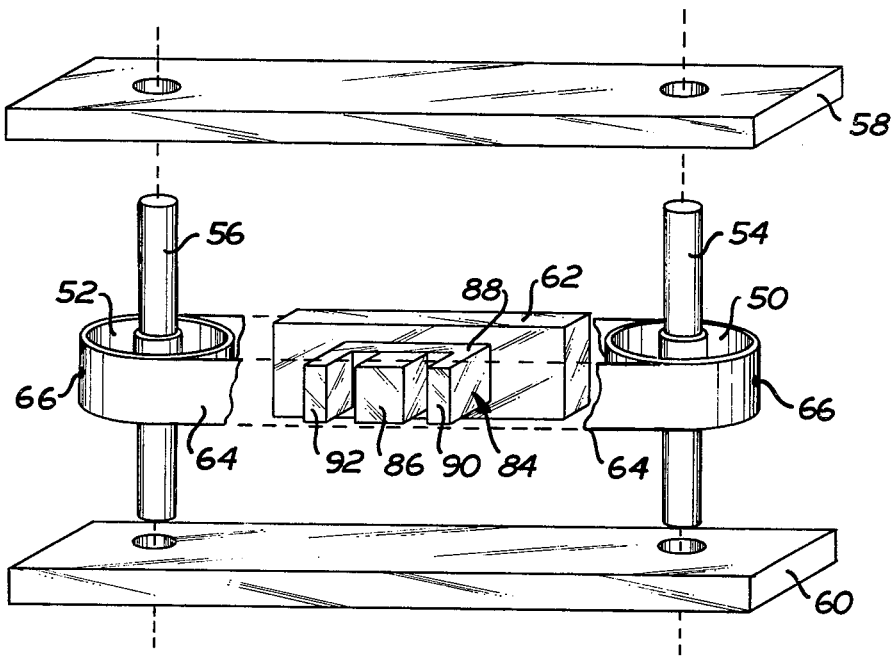
FIG. 4 is an exploded, perspective view of the shuttle drive.

In like fashion the opposite ends of the counterbalancing bar 72 are maintained in contact with the pulleys 50 and 52 through adjacent portions of the band 64 by a magnet assembly 84. The magnet assembly 84 which is identical in configuration to the magnet assembly 74 and which is shown in FIG. 4 includes a permanent magnet 86 mounted at an intermediate portion of a C-shaped pole piece 88 having opposite tips 90 and 92. A thin plate 93 is joined to the inside surface of the band 64 in the region of the magnet assembly 84.

The shuttle assembly 14 is driven via the pulleys 50 and 52 and the band 64 by a DC motor 94 coupled to bidirectionally, rotatably drive the pulley 50 via the shaft 54. The DC motor 94 has a pulley 96 at the lower end thereof coupled via a belt 98 to a pulley 100 mounted on the lower end of the shaft 54. The DC motor 94 is mounted on the base plate 34 of the printer 10 with the shaft thereof extending through an aperture in the base plate 34 so that the pulley 96 is disposed below the base plate 34. The shaft 54 also extends through an aperture in the base plate 34 and disposes the pulley 100 below the base plate 34.

The opposite limits of movement of the shuttle drive 12 are defined by a pair of stops 102 and 104 mounted adjacent the counterbalancing bar 72. The stop 102 includes a generally L-shaped frame 106 mounted on the base plate 34 and having a spring 108 mounted on and extending outwardly from the top portion thereof. Similarly, the stop 104 includes a generally L-shaped frame 110 mounted on the base plate 34 and a spring 112 mounted on and extending from the top portion of the frame 110. The stops 102 and 104 are mounted in spaced-apart relation along the length of the counterbalancing bar 72 such that the springs 108 and 112 thereof are alternately impacted by a rectangular impact element 114 mounted on the outer surface of the counterbalancing bar 72 so as to extend into the path of the springs 108 and 112.

The shuttle drive 12 behaves much in the same manner as the linear motor described in the previously referred to co-pending application of Matula. Each time one of the springs 108 and 112 is impacted by the element 114, enough energy is stored in the spring to cause rebound to the nominal driving speed with very little driving of the shuttle drive 12 being necessary. Accordingly, the circuit shown and described in the Matual application can be used to drive the DC motor 94 to the shuttle drive 12 of the present invention. Such circuit essentially relinquishes servo control during turnaround, thereby allowing the energy stored in the compressed springs 108 and 112 to do most of the work. When the shuttle drive 12 is almost up to the nominal speed, servo control is again instituted with a small amount of current being applied to the motor as necessary to maintain the nominal speed. Because the shuttle drive 12 has very low friction due to the design thereof including the fact that almost all of the friction comes from bearings used to rotatably mount the shafts 54 and 56, servo control during nominal speed is easily maintained and a relatively small DC motor 94 is required.

The drive circuit for the DC motor 94 is shown in FIG. 1 in conjunction with an encoder 116. The encoder 116 which is shown in detail in FIG. 7 senses the opposite limits of movement of the shuttle drive 12 and provides a signal representing the actual velocity of the shuttle drive 12 and the included shuttle assembly 14. Pulses from the encoder 116 representing shuttle velocity are amplified in a pre-amp 118 prior to be applied to a pulse generator 120 to provide corresponding timing signals. The timing signals from the pulse generator 120 are applied to a velocity correction loop 122 together with a speed adjustment signal representing the desired velocity of the shuttle assembly 14. The velocity correction loop 122 which corresponds to the phase locked loop in the circuit in the co-pending application of Matula comprises a logical clock which compares the timing signals with a clock time using a speed adjustment signal. The difference in the form of a velocity correction signal is applied to a summing junction 124 together with a signal from a bipolar reference signal generator 126. The bipolar reference signal generator 126 utilizes the pulses from the encoder 116 as a reference signal and corrects this signal to an absolute value. The resulting combination of signals at the output of the summing junction 124 is applied via a drive amplifier 128 to drive the DC motor 94.

Figure 5:
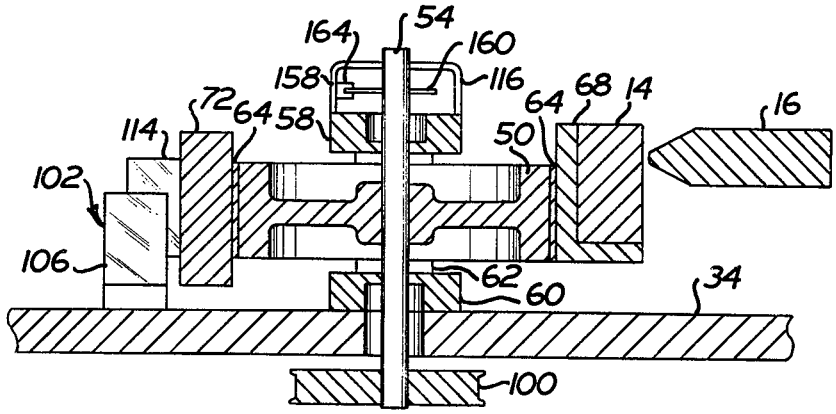
FIG. 5 is a sectional view of the portion of the printer of FIG. 1 shown in FIG. 2 and taken along the line 5—5 of FIG. 2.
Figure 6:
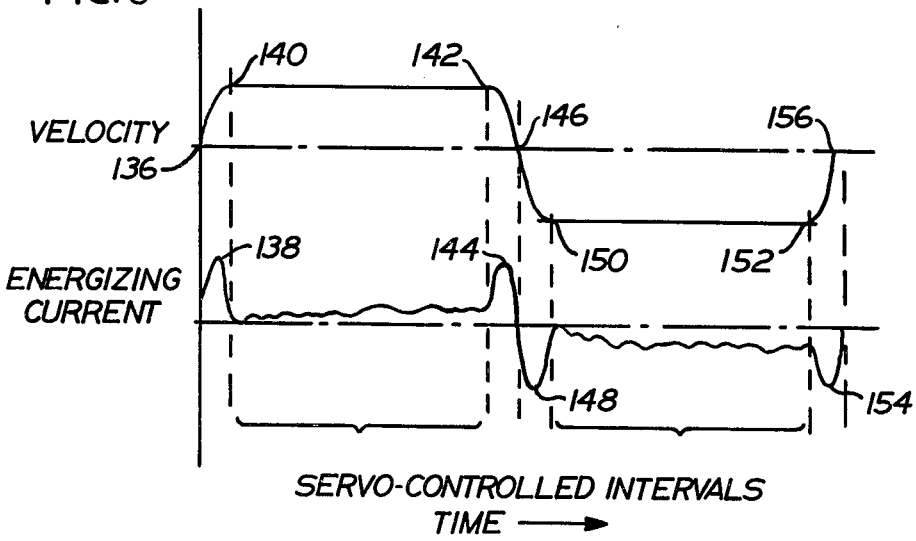
FIG. 6 are waveforms illustrating shuttle velocity and energizing current as a function of time.

FIG. 6 which depicts the velocity of the shuttle assembly 14 as a function of time and the corresponding energizing current which must be applied to the DC motor 94 to achieve the generally trapezoidal velocity characteristic corresponds to FIG. 5 of the co-pending application of Matula. As the velocity curve crosses zero at a point 136, the circuit of FIG. 1 responds by saturating in the appropriate direction to provide a relatively large pulse 138 to the DC motor 94. This pulse combines with the natural rebound action of the shuttle drive 12 to quickly accelerate the shuttle drive to the desired nominal velocity as determined by the velocity correction loop 122. When the shuttle drive 12 accelerates to a speed approximately 70% of the nominal speed, the circuit of FIG. 1 leaves the saturation region and thereafter provides a relatively small current to the DC motor 94 as necessary to enable the shuttle drive to quickly reach the nominal speed at a point 140. At the point 140 the energizing current to the DC motor 94 is reduced to zero or substantially to zero. Thereafter, as the shuttle drive 12 undergoes linear motion in the given direction between its opposite limits, the circuit of FIG. 1 provides a relatively small amount of energizing current to the DC motor 94 as necessary to compensate for friction losses and the like and maintain the nominal velocity of the shuttle drive 12.

When the shuttle drive 12 has traveled far enough for the impact element 114 to impact the other one of the springs 108 and 112, which correspond to a point 142 on the velocity curve of FIG. 6, the shuttle drive 12 rapidly decelerates. The circuit of FIG. 1 senses the resulting difference between actual and desired speed by providing an energizing current of increasing value to the DC motor 94. When the speed of the shuttle drive 12 has decreased to approximately 70% of the desired nominal speed, the circuit saturates and thereafter provides a relatively large pulse 144 to the DC motor 94. Nevertheless, the shuttle drive 12 continues to decelerate and comes to rest at a point 146 shown in FIG. 6 because of the resistance of the spring. Though the current pulse 144 opposes deceleration of the shuttle drive 12, this energy is not wasted but rather is transferred to the spring. When the shuttle drive 12 comes to rest at the point 146 and thereafter begins to reverse direction under the action of the compressed spring, the additional energy from the current pulse 144 is returned by the spring to the shuttle drive 12. At the same time the circuit of FIG. 1 which is in saturation and which reverses polarity at the point 146 of zero motion produces a relatively large pulse 148 so as to quickly accelerate the shuttle drive 12. When the shuttle drive 12 has accelerated to approximately 70% of the desired nominal speed, the circuit leaves the saturation state and provides a relatively small current to the DC motor 94 as determined by the actual value of the reducing error signal at the summing junction 124. As the shuttle drive 12 reaches the nominal speed represented by a point 150 on the velocity curve of FIG. 6 the energizing current provided by the circuit of FIG. 1 is reduced to zero or near zero and thereafter assumes relatively small values as necessary to compensate for friction losses and the like so as to maintain the linear motion of the shuttle drive 12 at the selected nominal speed.

As the shuttle drive 12 reaches its opposite limit and the impact element 14 impacts the other use of the springs 108 and 112 at a point 152 shown on the velocity curve of FIG. 6, the shuttle drive 12 begins to decelerate. When the shuttle drive 12 has decelerated to approximately 70% of nominal speed, the circuit of FIG. 1 saturates and thereafter produces a relatively large current pulse 154. As the shuttle drive 12 accelerates to zero at a point 156 shown in FIG. 6 the circuit remains saturated but reverses polarity.

Figure 7:
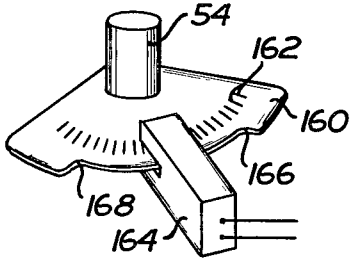
FIG. 7 is a perspective view of an arrangement for generating a velocity reference signal.
Figure 2:
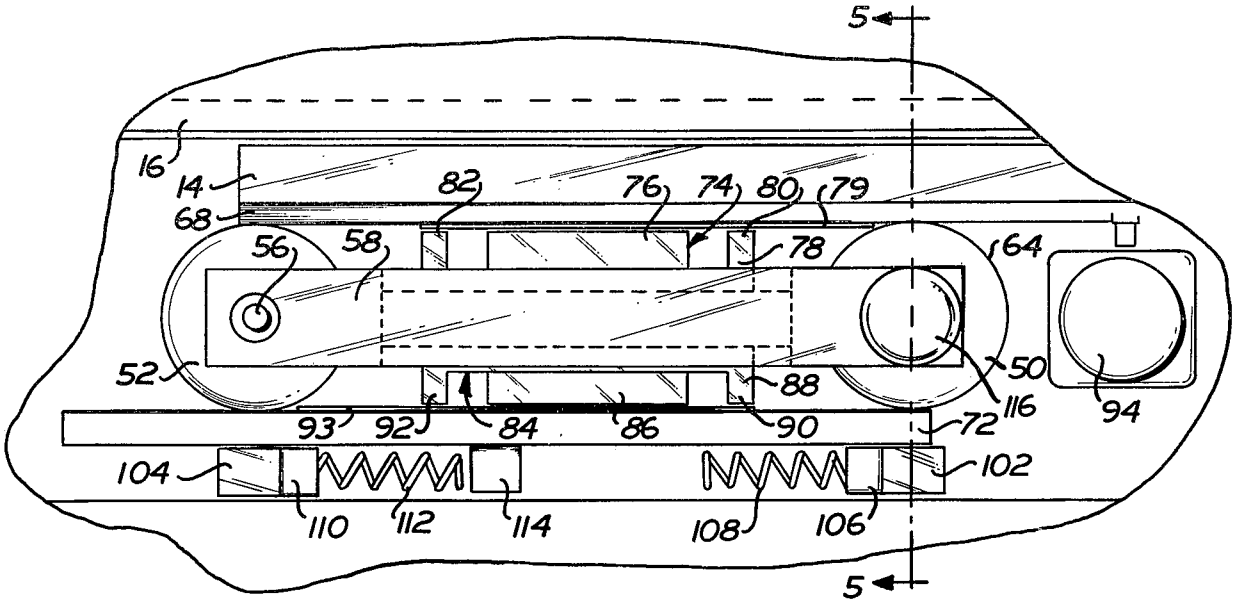
FIG. 2 is a top, plan view of a portion of the printer of FIG. 1 showing the shuttle drive.
Figure 3:
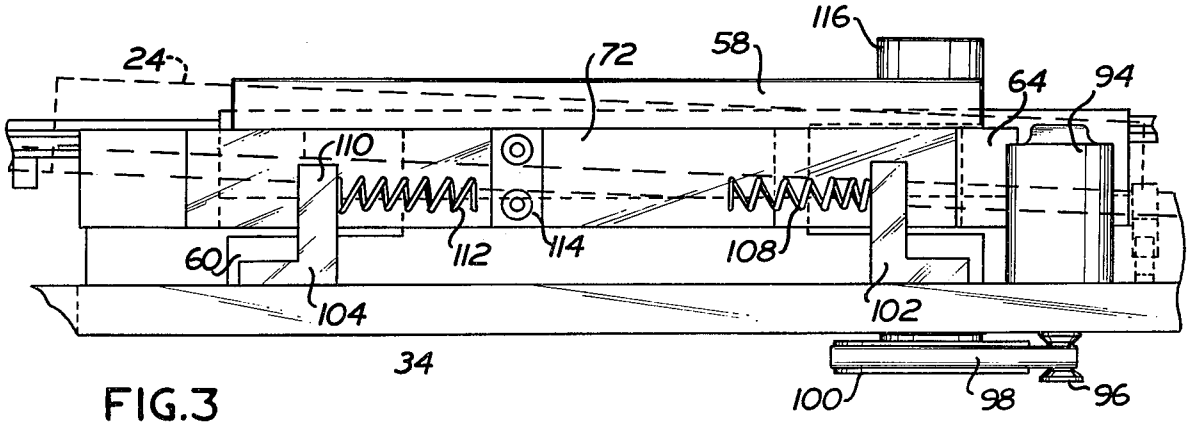
FIG. 3 is a front, elevation view of a portion of the printer of FIG. 1 showing the shuttle drive.

A portion of the encoder 116 of FIG. 1 is shown in FIG. 7. The encoder 116 comprises a hollow housing 158 which surrounds the top end of the shaft 54 and encloses an encoding element 160 in the form of a partial disk having a plurality of detectable items equally spaced about the outer periphery thereof. In the present example, the detectable items comprise slots 162. A photosensor 164 has a light-emitting element in one end thereof disposed to pass light to an opposite detector each time one of the slots 162 passes by, to provide an output pulse. The frequency of the pulses provides a direct indication of the velocity of the shuttle assembly 14 as well as a convenient reference. The outer periphery of the encoding element 160 terminates at the opposite ends thereof in a pair of edges 166 and 168. A second light-emitting element and detector within the photosensor 164 senses the occurrence of each edge 166 and 168 to provide a signal to the bipolar reference signal generator 126 indicating turnaround of the shuttle assembly 14.

While the invention has been particularly shown and described with reference to a preferred embodiment thereof, it will be understood by those skilled in the art that various changes in form and details may be made therein without departing from the spirit and scope of the invention.

What is claimed is:

1. An arrangement for bidirectionally driving a printing mechanism relative to a printable medium in a line printer comprising the combination of:

a pair of circular elements mounted in spaced-apart relation for rotation about a pair of generally parallel axes;

a band formed into an endless loop encircling a portion of each of the circular elements and extending between the circular elements on opposite sides of the circular elements;

a printing mechanism coupled to the band between the circular elements on one side of the circular elements;

an elongated element coupled to the band between the circular elements on the other side of the circular elements;

means for defining opposite limits of movement of the band; and means for bidirectionally driving the band between the opposite limits of movement thereof so as to bidirectionally drive the printing mechanism, the printing mechanism and the elongated element each having a length greater than the distance between the pair of generally parallel axes so as to bridge the space between the pair of circular elements.

2. The invention set forth in claim 1, wherein the elongated element has a mass substantially equal to the mass of the printing mechanism, and further including means for applying force to hold the opposite ends of each of the printing mechanism and the elongated element against the pair of circular elements through the band.

3. The invention set forth in claim 1, wherein the means for defining opposite limits of movement includes a spaced-apart pair of resilient elements and means associated with the elongated element for impacting one or the other of the resilient elements as the elongated element reaches the opposite limits of movement.

4. The invention set forth in claim 1, further including a first magnet mounted adjacent to and on the opposite side of the band from the elongated element, and a second magnet mounted adjacent to and on the opposite side of the band from the printing mechanism, the first magnet and the second magnet being operative to magnetically attract the elongated element and the printing mechanism respectively thereto.

5. The invention set forth in claim 1, wherein the means for bidirectionally driving the band includes a motor, means coupling the motor to rotatably drive one of the circular elements, and means for alternately energizing the motor in opposite senses to bidirectionally drive the motor.

6. The invention set forth in claim 5, wherein the means for alternately energizing the motor includes means for providing a first signal representing a desired velocity for the printing mechanism, means for providing a second signal representing the actual velocity of the printing mechanism, and means responsive to the first and second signals for driving the motor in accordance with any difference between the first and second signals.

7. An arrangement for bidirectionally driving a hammer bank shuttle assembly relative to a print paper in a line printer comprising the combination of:

a pair of pulleys mounted in spaced-apart relation for rotation about a pair of generally parallel axes;

a band arranged in an endless configuration encircling a portion of each of the pulleys and extending between the pulleys on opposite sides of the pulleys;

a hammer bank shuttle assembly coupled to the band between the pulleys on one side of the pulleys so as to undergo bidirectional, linear motion in response to bidirectional movement of the band around the pulleys;

an elongated, generally rectangular counterbalancing bar extending along and coupled to the band between the pulleys on the other side of the pulleys from the shuttle assembly so as to undergo bidirectional, linear motion in response to bidirectional movement of the band around the pulleys;

resilient means coupled to be impacted each time the counterbalancing bar reaches either of opposite limits of travel;

a motor coupled to drive one of the pulleys when energized;

means for alternately energizing the motor in opposite senses between impacts of the resilient means;

the shuttle assembly and the counterbalancing bar each having a length greater than the distance between the pair of generally parallel axes so that the opposite ends thereof bear against the pair of pulleys through the band at the opposite limits of travel and all positions in between of the counterbalancing bar; and means for holding the opposite ends of each of the shuttle assembly and the counterbalancing bar against the pair of pulleys through the band.

8. The invention set forth in claim 7, wherein the resilient means comprises an impact element mounted on the counterbalancing bar and a pair of springs mounted on opposite sides of the impact element along the length of the counterbalancing bar.

9. The invention set forth in claim 7, wherein the band is made of stainless steel and is fastened to each of the pulleys by a screw.

10. The invention set forth in claim 7, wherein the counterbalancing bar has a mass substantially equal to the mass of the shuttle assembly.

11. The invention set forth in claim 7, further including a shaft having one of the pair of pulleys mounted thereon, a third pulley mounted on the shaft, a fourth pulley mounted on the motor, and an endless belt partly encircling and extending between the third and fourth pulleys on opposite sides of the third and fourth pulleys.

12. An arrangement for bidirectionally driving a hammer bank shuttle assembly relative to a print paper in a line printer comprising the combination of:

a pair of pulleys mounted in spaced-apart relation for rotation about a pair of generally parallel axes;

a band arranged in an endless configuration encircling a portion of each of the pulleys and extending between the pulleys on opposite sides of the pulleys;

a hammer bank shuttle assembly coupled to the band between the pulleys on one side of the pulleys so as to undergo bidirectional, linear motion in response to bidirectional movement of the band around the pulleys;

an elongated, generally rectangular counterbalancing bar extending along and coupled to the band between the pulleys on the other side of the pulleys from the shuttle assembly so as to undergo bidirectional, linear motion in response to bidirectional movement of the band around the pulleys;

resilient means coupled to be impacted each time the counterbalancing bar reaches either of opposite limits of travel;

a motor coupled to drive one of the pulleys when energized;

means for alternately energizing the motor in opposite senses between impacts of the resilient means;

the shuttle assembly and the counterbalancing bar each having a length greater than the distance between the pairs of generally parallel axes so as to extend beyond each of the pair of pulleys;

a first pole piece having a pair of tips diposed slightly spaced-apart from the band opposite the shuttle assembly;

a first permanent magnet coupled to the first pole piece between the pair of tips disposed slightly spaced-apart from the band opposite the shuttle assembly;

a second pole piece having a pair of tips disposed slightly spaced-apart from the band opposite the counterbalancing bar; and a second permanent magnet coupled to the second pole piece between the pair of tips and disposed slightly spaced-apart from the band opposite the counterbalancing bar.

13. The invention set forth in claim 12, wherein the band is of non-magnetic material, and further including a first plate of magnetic material joined to the inside surface of the band so as to extend between and adjacent the pair of tips of the first pole piece and a second plate of magnetic material joined to the inside surface of the band so as to extend between and adjacent the pair of tips of the second pole piece.

14. The invention set forth in claim 7, wherein the means for alternately energizing the motor in opposite senses includes means for providing a first signal representing the velocity of the shuttle assembly, means for providing a second signal representing a desired velocity for the shuttle assembly and means for providing an energizing signal to the motor representing the difference between the first and second signals.

15. The invention set forth in claim 14, wherein the means for providing an energizing signal is operative to provide a relatively large energizing signal of substantially fixed value whenever the difference between the first and second signals exceeds a predetermined value.

16. The invention set forth in claim 14, further including a shaft rotatably mounting one of the pulleys, and wherein the means for providing a first signal representing the velocity of the shuttle assembly includes an element of at least partially circular configuration mounted on the shaft and having a plurality of detectable marks disposed in spaced-apart relation along the outer periphery thereof and a detector mounted in a fixed location relative to the outer periphery of the element and operative to generate pulses in response to movement of the detectable marks past the detector.

17. The invention set forth in claim 7, wherein the means for holding the opposite ends of each of the shuttle assembly and the counterbalancing bar includes a first magnet, means defining a magnetic path between the first magnet and the shuttle assembly, a second magnet and means defining a magnetic path between the second magnet and the counterbalancing bar.

* * * * *